US010950925B2

(12) United States Patent
Chen et al.

(10) Patent No.: US 10,950,925 B2
(45) Date of Patent: Mar. 16, 2021

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Yi-Ting Chen, New Taipei (TW); Yen-Jung Tseng, New Taipei (TW); Cho-Kang Hsu, New Taipei (TW); Jung-Sheng Chih, New Taipei (TW); Wen-Chang Hsu, New Taipei (TW); Min-Hui Ho, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 85 days.

(21) Appl. No.: 16/261,991

(22) Filed: Jan. 30, 2019

(65) Prior Publication Data

US 2019/0252765 A1 Aug. 15, 2019

(30) Foreign Application Priority Data

Feb. 9, 2018 (CN) ..... 2018 1 0136692

(51) Int. Cl.

| | |
|---|---|
| ***H01Q 1/38*** | (2006.01) |
| ***H01Q 1/24*** | (2006.01) |
| ***H01Q 1/48*** | (2006.01) |
| ***H01Q 5/378*** | (2015.01) |

(52) U.S. Cl.

CPC ..... *H01Q 1/243* (2013.01); *H01Q 1/38* (2013.01); *H01Q 1/48* (2013.01); *H01Q 5/378* (2015.01)

(58) Field of Classification Search

None

See application file for complete search history.

(56) References Cited

U.S. PATENT DOCUMENTS

2015/0022422 A1 1/2015 Chang et al.
2018/0034148 A1* 2/2018 Nam ..... H01Q 1/523

FOREIGN PATENT DOCUMENTS

| | | | |
|---|---|---|---|
| CN | 103236583 | A | 8/2013 |
| CN | 205960191 | U | 2/2017 |
| CN | 106816680 | A | 6/2017 |
| CN | 107039766 | A | 8/2017 |
| CN | 206532881 | U | 9/2017 |
| TW | 201505254 | A | 2/2015 |

* cited by examiner

*Primary Examiner* — Andrea Lindgren Baltzell
*Assistant Examiner* — Jianzi Chen
(74) *Attorney, Agent, or Firm* — ScienBiziP, P.C.

(57) ABSTRACT

An antenna structure includes a housing, a feeding portion, and a connecting portion. The housing defines a gap and a groove. The housing forms a radiating portion and a coupling portion through the gap and the groove. A portion of the housing between the feeding portion and the gap forms a first radiating section. The connecting portion is electrically connected to one end of the coupling portion adjacent to the gap. When the feeding portion supplies current, the current flows through the feeding portion and the first radiating section, and is coupled to the connecting portion through the gap to activate a first operating mode. When the feeding portion supplies current, the current flows through the feeding portion and the first radiating section, and is coupled to the coupling portion through the gap to activate a second operating mode.

14 Claims, 7 Drawing Sheets

ANTENNA STRUCTURE AND WIRELESS COMMUNICATION DEVICE USING THE SAME

FIELD

The subject matter herein generally relates to an antenna structure and a wireless communication device using the antenna structure.

BACKGROUND

Antennas are important components in wireless communication devices for receiving and transmitting wireless signals at different frequencies, such as signals in Long Term Evolution Advanced (LTE-A) frequency bands. However, the antenna structure is complicated and occupies a large space in the wireless communication device, which is inconvenient for miniaturization of the wireless communication device.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
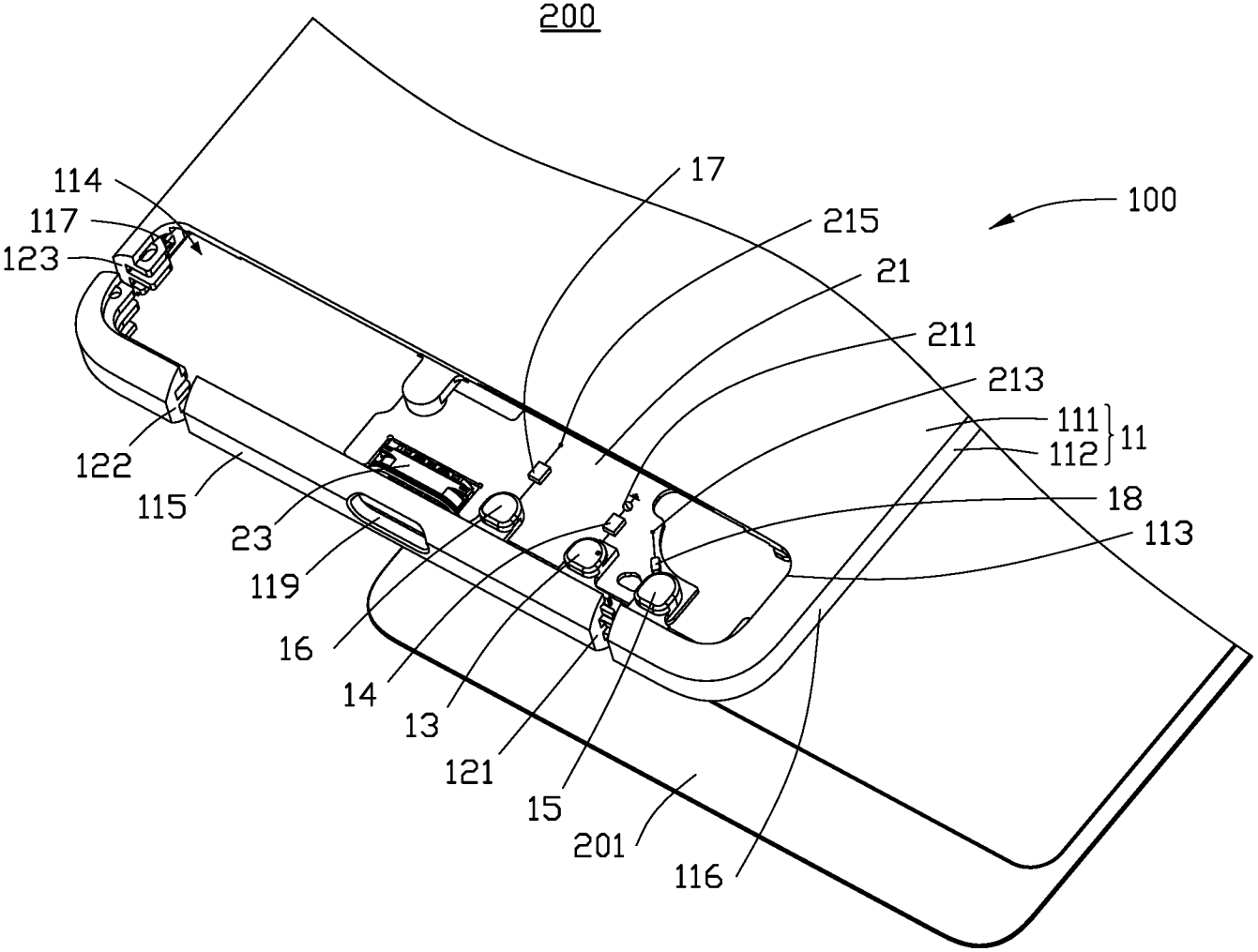
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using the same.

Figure 2:
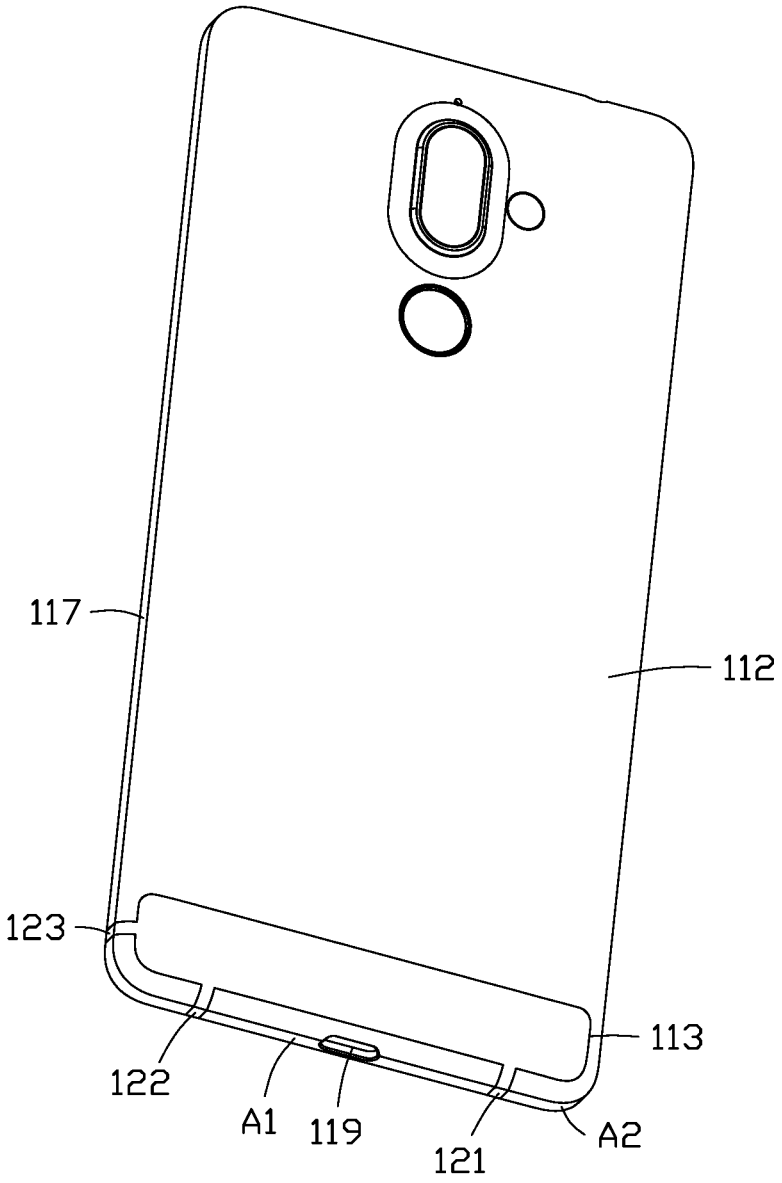
FIG. 2 is an assembled, isometric view of the wireless communication device of FIG. 1.

FIG. 1 and FIG. 2 illustrate an embodiment of a wireless communication device 200 using an antenna structure 100. The wireless communication device 200 can be, for example, a mobile phone or a personal digital assistant. The antenna structure 100 can receive and transmit wireless signals.

The wireless communication device 200 further includes a substrate 21 and an electronic element 23. In an embodiment, the substrate 21 is made of dielectric material, for example, epoxy resin glass fiber (FR4) or the like. The substrate 21 includes a feed source 211, a first ground point 213, and a second ground point 215. The feed source 211 is configured to supply current to the antenna structure 100. The first ground point 213 and the second ground point 215 are positioned at two sides of the feed source 211. The first ground point 213 and the second ground point 215 are configured for grounding the antenna structure 100.

The electronic element 23 is a Universal Serial Bus (USB) module. The electronic element 23 is positioned on the substrate 21 and is positioned at one side of the second ground point 215 away from the feed source 211.

Figure 3:
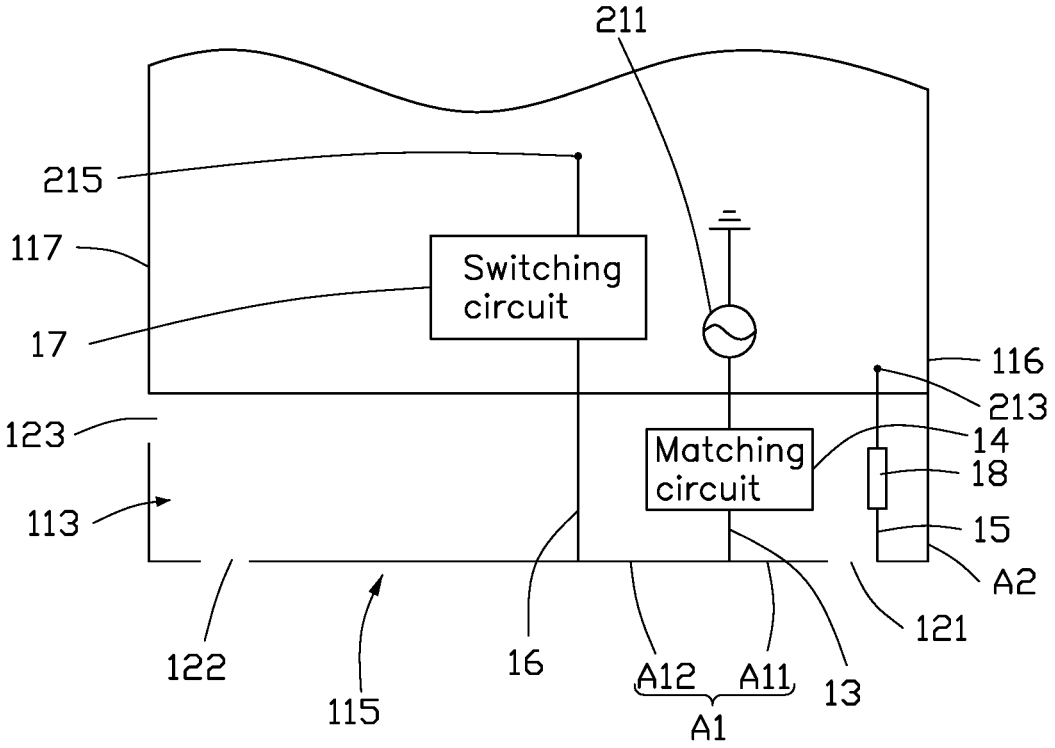
FIG. 3 is a circuit diagram of the antenna structure of FIG. 1.

FIG. 3 shows the antenna structure 100 includes a housing 11, a feeding portion 13, a matching circuit 14, a connecting portion 15, and a grounding portion 16.

The housing 11 contains the wireless communication device 200. The housing 11 includes at least a backboard 111 and a side frame 112. In an embodiment, the backboard 111 is made of metallic material. The backboard 111 adjacent to a bottom position of the wireless communication device 200 defines an opening 113. The opening 113 is substantially rectangular.

The side frame 112 is made of metallic material. The side frame 112 is substantially annular. The side frame 112 can be integral with the backboard 111. The side frame 112 defines an opening (not labeled). The wireless communication device 200 includes a display 201. The display 201 is received in the opening. The display 201 has a display surface. The display surface is exposed at the opening and is positioned parallel to the backboard 111. In an embodiment, the side frame 112 is positioned around a periphery of the backboard 111. The side frame 112 forms a receiving space 114 together with the display 201 and the backboard 111. The receiving space 114 can receive the substrate 21, the electronic element 23, a processing unit, or other electronic components or modules. In an embodiment, the substrate 21 corresponds in size to the opening 113.

In an embodiment, the side frame 112 includes an end portion 115, a first side portion 116, and a second side portion 117. The end portion 115 is a bottom portion of the wireless communication device 200. The first side portion 116 is spaced apart from and parallel to the second side portion 117. The end portion 115 has first and second ends. The first side portion 116 is connected to the first end of the end portion 115 and the second side portion 117 is connected to the second end of the end portion 115. The end portion 115, the first side portion 116, and the second side portion 117 are all perpendicularly connected to the backboard 111.

The end portion 115, the first side portion 116, and the second side portion 117 are all integral with the backboard 111.

The side frame 112 further defines a through hole 119, a gap 121, and a groove 122. The through hole 119 is defined at a middle position of the end portion 115 and passes through the end portion 115. The through hole 119 corresponds to the electronic element 23. Then, the electronic element 23 is partially exposed from the through hole 119. A USB device can be inserted in the through hole 119 and be electrically connected to the electronic element 23.

In an embodiment, the gap 121 is defined at the side frame 112 between the through hole 119 and the first side portion 116. The gap 121 passes through and extends to cut across the side frame 112. The gap 121 further extends to the backboard 111 for communicating with the opening 113. The groove 122 is defined at the side frame 112 between the through hole 119 and the second side portion 117. The groove 122 passes through and extends to cut across the side frame 112. The groove 122 also extends to the backboard 111 for communicating with the opening 113.

In an embodiment, the housing 11 is divided into two portions by the gap 121 and the groove 122. The two portions are a radiating portion A1 and a coupling portion A2. A first portion of the side frame 112 between the gap 121 and the groove 122, and a second portion of the backboard 111 positioned at a side of the opening 113 cooperatively form the radiating portion A1. A first portion of the side frame 112 extends from a side of the gap 121 away from the groove 122 to a side of the first side portion 116, and a second portion of the backboard 111 positioned at a side of the opening 113 cooperatively form the coupling portion A2. In an embodiment, the radiating portion A1 is longer than the coupling portion A2.

In other embodiments, the opening 113 can also be completely defined at the bottom position of the backboard 111. Then, the radiating portion A1 and the coupling portion A2 may be completely formed by the side frame 112.

In an embodiment, the feeding portion 13 can be a screw, a microstrip line, a probe, or other connecting structures. The feeding portion 13 is positioned in the receiving space 114. One end of the feeding portion 13 is electrically connected to one side of the radiating portion A1 adjacent to the gap 121. Another end of the feeding portion 13 is electrically connected to the feed source 211 through the matching circuit 14 for feeding current to the radiating portion A1. Another end of the feed source 211 is electrically connected to the substrate 21.

In an embodiment, the feeding portion 13 further divides the radiating portion A1 into two portions. The two portions are a first radiating section A11 and a second radiating section A12. A portion of the housing 11 between the gap 121 and the feeding portion 13 forms the first radiating section A11. A portion of the housing 11 between the groove 122 and the feeding portion 13 forms the second radiating section A12. In an embodiment, a location of the feeding portion 13 does not correspond to a middle position of the radiating portion A1, the second radiating section A12 is longer than the first radiating section A11.

The connecting portion 15 can be a screw, a microstrip line, a probe, or other connecting structures. The connecting portion 15 is positioned in the receiving space 114. One end of the connecting portion 15 is electrically connected to one end of the coupling portion A2 adjacent to the gap 121. Another end of the connecting portion 15 is electrically connected to the first ground point 213 for grounding the coupling portion A2.

The grounding portion 16 can be a screw, a microstrip line, a probe, or other connecting structures. The grounding portion 16 is positioned in the receiving space 114 between the electronic element 23 and the feeding portion 13. One end of the grounding portion 16 is electrically connected to one side of the second radiating section A12 adjacent to the feeding portion 13. Another end of the grounding portion 16 is electrically connected to the second ground point 215 for grounding the second radiating section A12.

Figure 4:
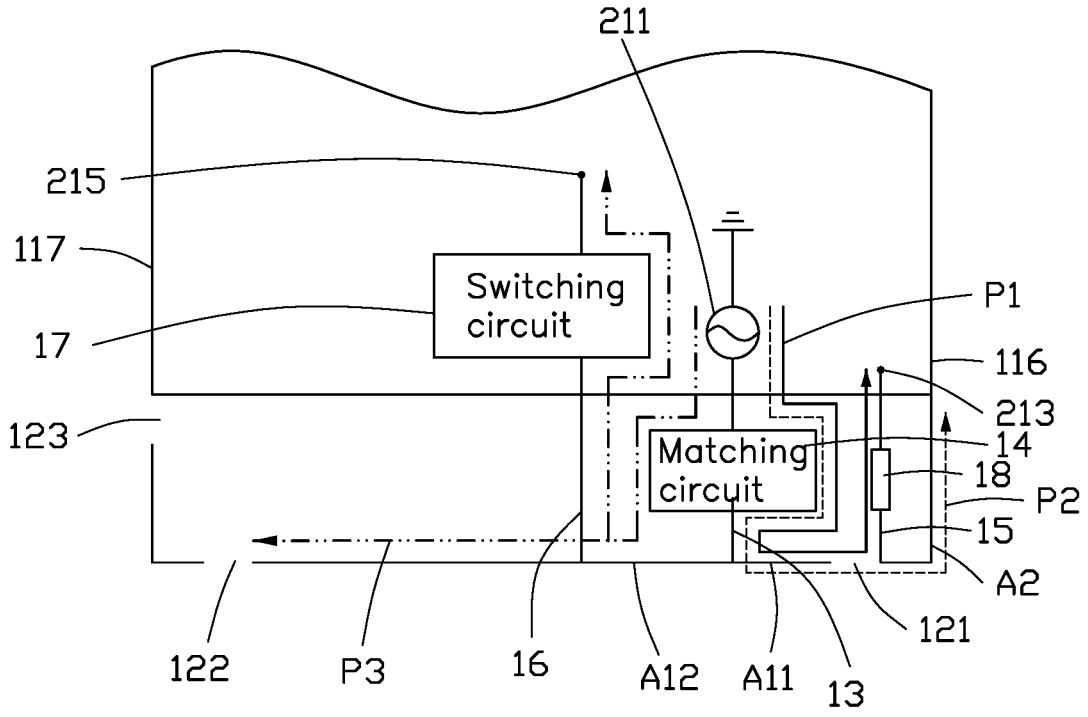
FIG. 4 is a current path distribution graph of the antenna structure of FIG. 3.

FIG. 4 shows, in an embodiment, when the feed source 211 supplies current, the current flows through the matching circuit 14, the feeding portion 13, and the first radiating section A11. The current is then coupled to the connecting portion 15 through the gap 121, and is grounded through the connecting portion 15 (Per path P1). Then the first radiating section A11 activates a first operating mode to generate radiation signals in a first radiation frequency band.

When the feed source 211 supplies current, the current flows through the matching circuit 14, the feeding portion 13, and the first radiating section A11. The current is then coupled to the coupling portion A2 through the gap 121, and is grounded through the backboard 111 and the side frame 112 (Per path P2). Then the feed source 211 and the coupling portion A2 cooperatively form a coupling-feed antenna through the gap 121 to activate a second operating mode to generate radiation signals in a second radiation frequency band.

When the feed source 211 supplies current, the current flows through the matching circuit 14, the feeding portion 13, and the second radiating section A12. The current is then grounded through the grounding portion 16 (Per path P3). Then the feed source 211, the feeding portion 13, the second radiating section A12, and the grounding portion 16 cooperatively form an inverted-F antenna to activate a third operating mode to generate radiation signals in a third radiation frequency band.

In an embodiment, a frequency of the second radiation frequency band is higher than a frequency of the first radiation frequency band. A frequency of the first radiation frequency band is higher than a frequency of the third radiation frequency band. The first operating mode is a LTE-A middle frequency operating mode. The second operating mode is a LTE-A high frequency operating mode. The third operating mode is a LTE-A low frequency operating mode. In an embodiment, the first radiation frequency band and the second radiation frequency are about LTE-A 1710-2690 MHz. The third radiation frequency band is about LTE-A 703-960 MHz.

Figure 5:
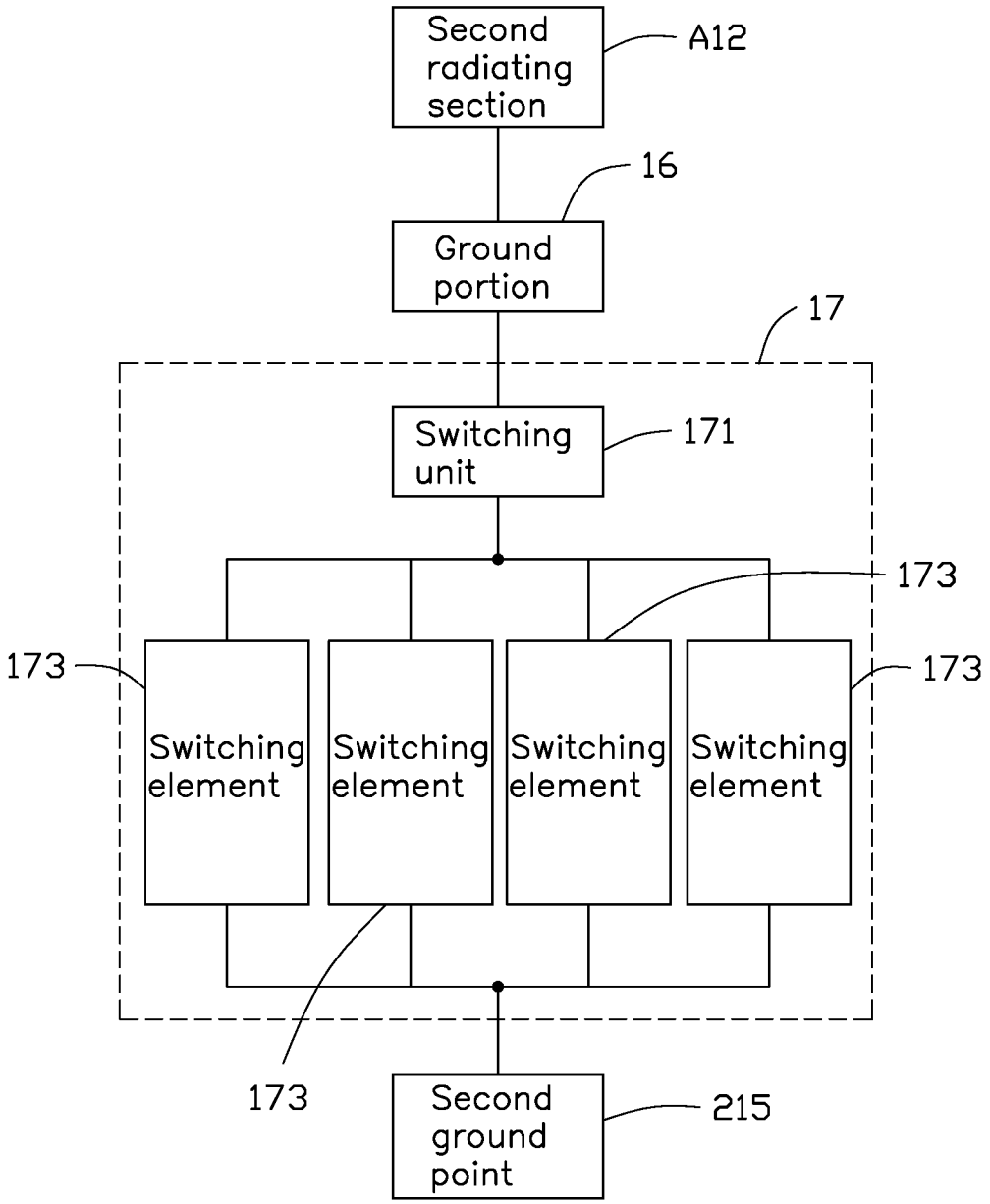
FIG. 5 is a circuit diagram of a switching circuit of the antenna structure of FIG. 3.

FIG. 5 shows, in an embodiment, the antenna structure 100 further includes a switching circuit 17. One end of the switching circuit 17 is electrically connected to the grounding portion 16. Then, the switching circuit 17 is electrically connected to the second radiating section A12 through the grounding portion 16. Another end of the switching circuit 17 is electrically connected to the second ground point 215 to be grounded.

In an embodiment, the switching circuit 17 includes a switching unit 171 and a plurality of switching elements 173. The switching unit 171 is electrically connected to the grounding portion 16. Then, the switching unit 171 is electrically connected to the second radiating section A12 through the grounding portion 16. The switching elements 173 can be an inductor, a capacitor, or a combination of the inductor and the capacitor. The switching elements 173 are connected in parallel to each other. One end of each switching element 173 is electrically connected to the switching unit 171. The other end of each switching element 173 is electrically connected to the second ground point 215 to be grounded.

Through control of the switching unit 171, the second radiating section A12 can be switched to connect with different switching elements 173. Since each switching element 173 has a different impedance, the third radiation frequency band of the antenna structure 100 can be effectively adjusted.

For example, in an embodiment, the switching circuit 17 includes four different switching elements 173. Through control of the switching unit 171, the second radiating section A12 can be switched to connect with the four different switching elements 173. Then, a low frequency band of the antenna structure 100 (that is, the third radiation frequency band) can cover a frequency band of LTE-A 703-804 MHz (LTE-A Band 28), a frequency band of LTE-A 791-862 MHz (LTE-A Band 20), a frequency band of LTE-A 824-894 MHz (LTE-A Band 5), and a frequency band of LTE-A 880-960 MHz (LTE-A Band 8).

FIGS. 1 and 3 show, in an embodiment, the antenna structure 100 further includes a frequency adjusting unit 18. In an embodiment, the frequency adjusting unit 18 is an inductor. One end of the frequency adjusting unit 18 is electrically connected to the connecting portion 15. Then the frequency adjusting unit 18 is electrically connected to the coupling portion A2 through the connecting portion 15. Another end of the frequency adjusting unit 18 is electrically connected to the first ground point 213 to be grounded.

Through adjusting an inductance value of the frequency adjusting unit 18, frequencies of the first operating mode and the second operating mode can be adjusted, such that a frequency of the second operating mode may cover more than 3000 MHz.

In an embodiment, the side frame 112 further defines a slot 123. The slot 123 is defined at one side of the second side portion 117 adjacent to the groove 122. The slot 123 passes through and extends to cut across the side frame 112. The slot 123 further extends to the backboard 111 for communicating with the opening 113. The slot 123 is configured to control a low frequency current path of the antenna structure 100 being opened at the end without being connected to a ground system of the wireless communication device 200, thereby effectively reducing an influence of human contact on the third radiation frequency band (that is, the low frequency of the antenna structure).

Generally, the larger the width of the gap 121, the groove 122, and the slot 123, the better the efficiency of the antenna structure 100. However, in consideration of an overall design aesthetics and the antenna radiation efficiency of the wireless communication device 200, in an embodiment, the width of the gap 121, the groove 122, and the slot 123 is about 1-3 mm, preferably, is about 2 mm.

In an embodiment, the gap 121, the groove 122, the slot 123, and the opening 113 are all filled with insulating material, for example, plastic, rubber, glass, wood, ceramic, or the like. When the opening 113 is filled with the insulating material, which can effectively prevent the opening 113 from affecting a radiation of the antenna structure 100. When the opening 113 is filled with the insulating material, the insulating material filled in the opening 113 may be surface treatment, for example, a plating treatment, so that the backboard 111 can have a metallic appearance and have a metallic texture.

Figure 6:
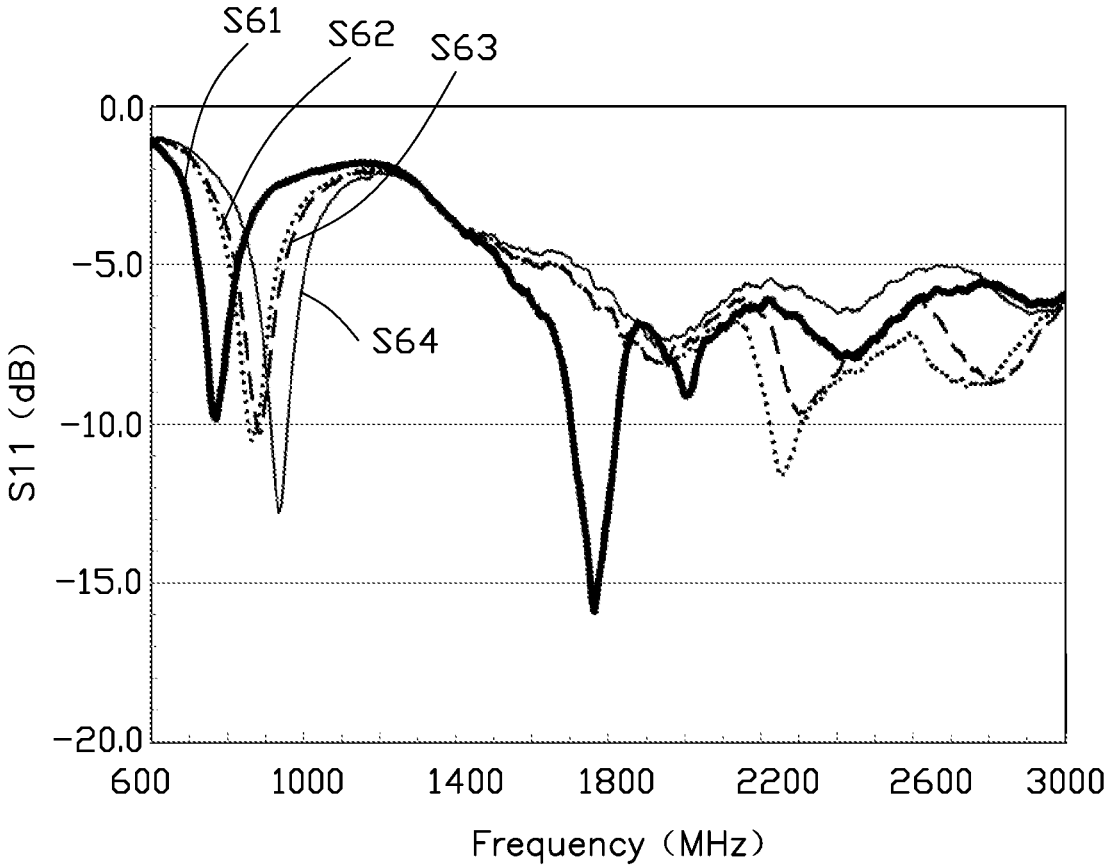
FIG. 6 is a scattering parameter graph of the antenna structure of FIG. 1.

FIG. 6 is a scattering parameter graph of the antenna structure 100. Curves S61-S64 respectively correspond to a scattering parameter of the antenna structure 100 when the switching circuit 17 is switched to connect with four different switching elements 173.

For example, the curve S61 is a scattering parameter when the switching circuit 17 is switched to connect with one switching element 173 and the antenna structure 100 works at a frequency band of 703-803 MHz (LTE-A Band 28). Curve S62 is a scattering parameter when the switching circuit 17 is switched to connect with one switching element 173 and the antenna structure 100 works at a frequency band of 791-862 MHz (LTE-A Band 20). The curve S63 is a scattering parameter when the switching circuit 17 is switched to connect with one switching element 173 and the antenna structure 100 works at a frequency band of 824-894 MHz (LTE-A Band 5). Curve S64 is a scattering parameter when the switching circuit 17 is switched to connect with one switching element 173 and the antenna structure 100 works at a frequency band of 880-960 MHz (LTE-A Band 8).

Figure 7:
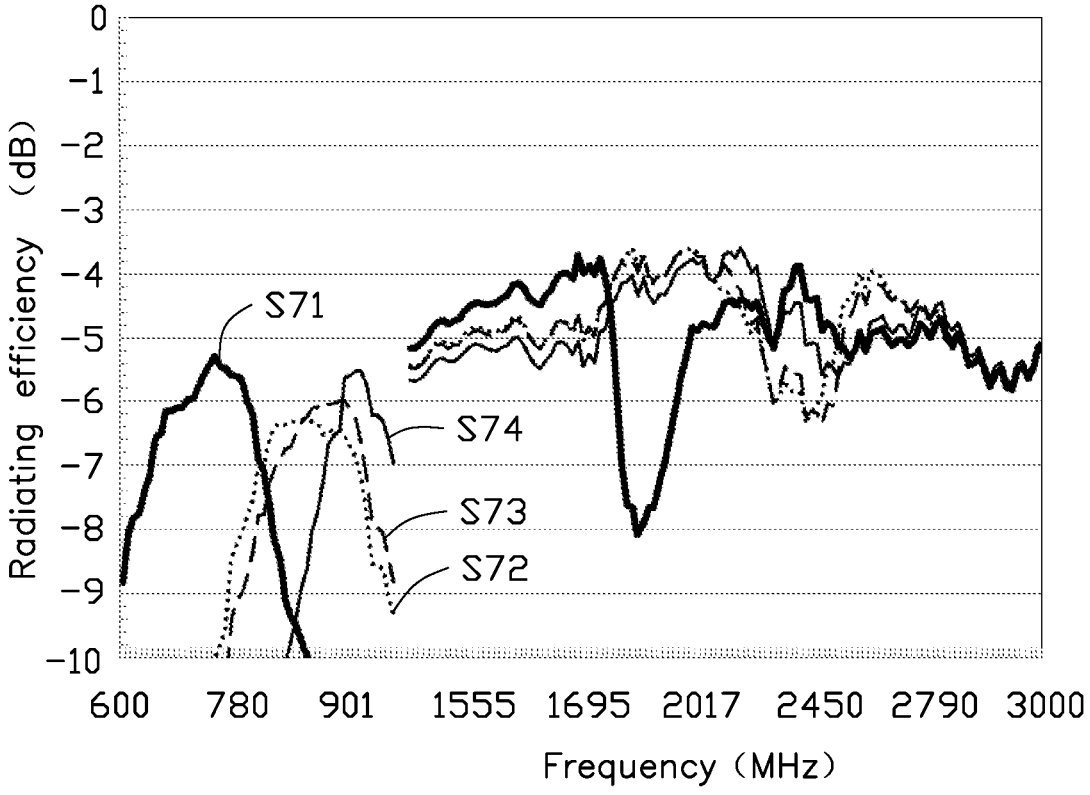
FIG. 7 is a radiating efficiency graph of the antenna structure of FIG. 1.

FIG. 7 is a radiating efficiency graph of the antenna structure 100. Curves S71-S74 respectively correspond to a radiating efficiency of the antenna structure 100 when the switching circuit 17 is switched to connect with four different switching elements 173.

For example, curve S71 is a radiating efficiency when the switching circuit 17 is switched to connect with one switching element 173 and the antenna structure 100 works at a frequency band of 703-803 MHz (LTE-A Band 28). Curve S72 is a radiating efficiency when the switching circuit 17 is switched to connect with one switching element 173 and the antenna structure 100 works at a frequency band of 791-862 MHz (LTE-A Band 20). Curve S73 is a radiating efficiency when the switching circuit 17 is switched to connect with one switching element 173 and the antenna structure 100 works at a frequency band of 824-894 MHz (LTE-A Band 5). Curve S74 is a radiating efficiency when the switching circuit 17 is switched to connect with one switching element 173 and the antenna structure 100 works at a frequency band of 880-960 MHz (LTE-A Band 8).

In FIG. 6 and FIG. 7, through control of the switching circuit 17, the low frequency operating mode of the antenna structure 100 can cover LTE-A Band 28/20/5/8. The middle and high frequency bands of the antenna structure 100 can also cover common communication channels. Additionally, when the antenna structure 100 works at these frequency bands, a scattering parameter of the antenna structure 100 is less than −5 dB, which satisfies antenna design requirements.

In an embodiment, the working frequencies of the antenna structure 100 can cover frequency bands of LTE-A 703-960 MHz, LTE-A 1710-2690 MHz, and even exceeds 3000 MHz. Then, the antenna structure 100 can be fully applied to the frequency bands of GSM Qual-band, UMTS Band I/II/V/VIII, and LTE 700/850/900/1800/1900/2100/2300/2500.

As described above, the antenna structure 100 defines the gap 121 and the groove 122, then the housing 11 is divided into a radiating portion A1 and a coupling portion A2. Through the feeding portion 13, the radiating portion A1 is further divided into a first radiating section A11 and the second radiating section A12. When the feed source 211 supplies current, the current flows through the first radiating section A11 and is coupled to the connecting portion 15 through the gap 121, thereby activating the first operating mode to generate radiation signals in the LTE-A middle frequency band. The current flowing through the first radiating section A11 is further coupled to the coupling portion A2 through the gap 121. Then the coupling portion A2 activates the second operating mode to generate radiation signals in the LTE-A middle frequency band. In addition, when the feed source 211 supplies current, the current directly flows through the second radiating section A12 and is grounded through the grounding portion 16 to activate the third operating mode to generate radiation signals in the LTE-A low frequency band. The wireless communication device 200 can use carrier aggregation (CA) technology of LTE-A to receive or send wireless signals at multiple frequency bands simultaneously.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a housing, the housing being made of metallic material and comprising a side frame and a backboard connecting to the side frame, the housing defining a gap, a groove, and a slot, the gap, the groove, and the slot all extending to cut across the side frame and connecting to a portion of the backboard, one end of the backboard defining an opening, the opening being rectangular and corresponding to the antenna structure, the gap, the groove, and the slot all communicated with two sides of the opening, the opening being filled with insulating material, the insulating material filled in the opening being surface treatment, and a surface of the insulating material filled in the opening being consistent with a surface appearance of the backboard; a portion of the housing between the gap and the groove forming a radiating portion, a portion of the housing extending from a side of the gap away from the radiating portion forming a coupling portion;

a feeding portion, one end of the feeding portion supplying current, another end of the feeding portion electrically connected to the radiating portion, a portion of the housing between the feeding portion and the gap forming a first radiating section; and a connecting portion, one end of the connecting portion electrically connected to one end of the coupling portion adjacent to the gap, another end of the connecting portion being grounded;

wherein when the feeding portion supplies current, the current flows through the feeding portion and the first radiating section, and is coupled to the connecting portion through the gap to activate a first operating mode to generate radiation signals in a first radiation frequency band; and wherein when the feeding portion supplies current, the current flows through the feeding portion and the first radiating section, and is coupled to the coupling portion through the gap to activate a second operating mode to generate radiation signals in a second radiation frequency band.

2. The antenna structure of claim 1, further comprising a frequency adjusting unit, wherein the frequency adjusting unit is an inductor, one end of the frequency adjusting unit is electrically connected to the coupling portion through the connecting portion, another end of the frequency adjusting unit is grounded, the frequency adjusting unit is configured to adjust frequencies of the first radiation frequency band and the second radiation frequency band.

3. The antenna structure of claim 1, wherein a portion of the housing between the feeding portion and the groove forms a second radiating section, the antenna structure further comprises a grounding portion; wherein one end of the grounding portion is electrically connected to the second radiating section, another end of the grounding portion is grounded; wherein when the feeding portion supplies current, the current flows through the feeding portion and the second radiating section, and is grounded through the grounding portion to activate a third operating mode to generate radiation signals in a third radiation frequency band; wherein a frequency of the second radiation frequency band is higher than a frequency of the first radiation frequency band, and a frequency of the first radiation frequency band is higher than a frequency of the third radiation frequency band.

4. The antenna structure of claim 3, wherein a wireless communication device uses the first radiating section, the second radiating section, and the coupling portion to receive or send wireless signals at multiple frequency bands simultaneously through carrier aggregation (CA) technology of Long Term Evolution Advanced (LTE-A).

5. The antenna structure of claim 3, wherein the side frame comprises an end portion, a first side portion, and a second side portion, the first side portion and the second side portion are respectively connected to two ends of the end portion; wherein the gap is defined at a location of the end portion adjacent to the first side portion, the groove is defined at a location of the end portion adjacent to the second side portion; the slot is defined at one side of the groove away from the gap, and is configure to reduce an influence of human contact on the third radiation frequency band.

6. The antenna structure of claim 5, wherein the gap, the groove, and the slot are all filled with insulating material.

7. The antenna structure of claim 5, wherein the first radiating section, the second radiating section, and the coupling portion are positioned at the side frame and the backboard positioned at one side of the opening and connecting to the side frame.

8. A wireless communication device comprising:

an antenna structure, the antenna structure comprising:

a housing, the housing being made of metallic material and comprising a side frame and a backboard connecting to the side frame, the housing defining a gap, a groove, and a slot, the gap the groove, and the slot all extending to cut across the side frame and connecting to a portion of the backboard, one end of the backboard defining an opening, the opening being rectangular and corresponding to the antenna structure, the gap, the groove, and the slot all communicated with two sides of the opening, the opening being filled with insulating material, the insulating material filled in the opening being surface treatment, and a surface of the insulating material filled in the opening being consistent with a surface appearance of the backboard; a portion of the housing between the gap and the groove forming a radiating portion, a portion of the housing extending from a side of the gap away from the radiating portion forming a coupling portion;

a feeding portion, one end of the feeding portion supplying current, another end of the feeding portion electrically connected to the radiating portion, a portion of the housing between the feeding portion and the gap forming a first radiating section; and a connecting portion, one end of the connecting portion electrically connected to one end of the coupling portion adjacent to the gap, another end of the connecting portion being grounded;

wherein when the feeding portion supplies current, the current flows through the feeding portion and the first radiating section, and is coupled to the connecting portion through the gap to activate a first operating mode to generate radiation signals in a first radiation frequency band; and wherein when the feeding portion supplies current, the current flows through the feeding portion and the first radiating section, and is coupled to the coupling portion through the gap to activate a second operating mode to generate radiation signals in a second radiation frequency band.

9. The wireless communication device of claim 8, wherein the antenna structure further comprises a frequency adjusting unit, the frequency adjusting unit is an inductor, one end of the frequency adjusting unit is electrically connected to the coupling portion through the connecting portion, another end of the frequency adjusting unit is grounded, the frequency adjusting unit is configured to adjust frequencies of the first radiation frequency band and the second radiation frequency band.

10. The wireless communication device of claim 8, wherein a portion of the housing between the feeding portion and the groove forms a second radiating section, the antenna structure further comprises a grounding portion; wherein one end of the grounding portion is electrically connected to the second radiating section, another end of the grounding portion is grounded; wherein when the feeding portion supplies current, the current flows through the feeding portion and the second radiating section, and is grounded through the grounding portion to activate a third operating mode to generate radiation signals in a third radiation frequency band; wherein a frequency of the second radiation frequency band is higher than a frequency of the first radiation frequency band, and a frequency of the first radiation frequency band is higher than a frequency of the third radiation frequency band.

11. The wireless communication device of claim 10, wherein the wireless communication device uses the first radiating section, the second radiating section, and the coupling portion to receive or send wireless signals at multiple frequency bands simultaneously through carrier aggregation (CA) technology of Long Term Evolution Advanced (LTE-A).

12. The wireless communication device of claim 10, wherein the side frame comprises an end portion, a first side portion, and a second side portion, the first side portion and the second side portion are respectively connected to two ends of the end portion; wherein the gap is defined at a location of the end portion adjacent to the first side portion, the groove is defined at a location of the end portion adjacent to the second side portion; the slot is defined at one side of the groove away from the gap, and is configure to reduce an influence of human contact on the third radiation frequency band.

13. The wireless communication device of claim 12, wherein the gap, the groove, and the slot are all filled with insulating material.

14. The wireless communication device of claim 12, wherein the first radiating section, the second radiating section, and the coupling portion are positioned at the side frame and the backboard positioned at one side of the opening and connecting to the side frame.

* * * * *